US011051387B1

(12) United States Patent
Watson et al.

(10) Patent No.: US 11,051,387 B1
(45) Date of Patent: Jun. 29, 2021

(54) ULTRAVIOLET (UV) LIGHT EMITTING DEVICE (LED) DRIVEN PHOTOCATHODE

(71) Applicant: Triad National Security, LLC, Los Alamos, NM (US)

(72) Inventors: Scott Avery Watson, Jemez Springs, NM (US); Nicola Maree Winch, Los Alamos, NM (US); David Platts, Los Alamos, NM (US); Samuel A. Salazar, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 16/661,946

(22) Filed: Oct. 23, 2019

Related U.S. Application Data

(60) Provisional application No. 62/752,326, filed on Oct. 29, 2018.

(51) Int. Cl.
*H05G 1/12* (2006.01)
*H01J 35/06* (2006.01)

(52) U.S. Cl.
CPC ..... *H05G 1/12* (2013.01); *H01J 35/065* (2013.01)

(58) Field of Classification Search
CPC ..... H05G 1/12; H01J 35/065
See application file for complete search history.

(56) References Cited

U.S. PATENT DOCUMENTS 5,680,431 A 10/1997 Pietras et al.
9,117,622 B2 8/2015 Gendreau et al.
2015/0371806 A1* 12/2015 Watson ..... H05G 1/20 315/8.51

* cited by examiner

*Primary Examiner* — Mark R Gaworecki
(74) *Attorney, Agent, or Firm* — LeonardPatel PC

(57) ABSTRACT

An apparatus includes an electromechanical x-ray generator (MEXRAY) configured to charged capacitors using a small, high-voltage direct current. The apparatus also includes an ultraviolet (UV) light emitting diode (LED) driven photocathode device configured to control/modulate an electron dose rate of the MEXRAY or other vacuum DC, source.

20 Claims, 4 Drawing Sheets

300

302

ULTRAVIOLET (UV) LIGHT EMITTING DEVICE (LED) DRIVEN PHOTOCATHODE

CROSS-REFERENCE TO RELATED APPLICATION

This application claims the benefit of U.S. Provisional Patent Application No. 62/752,326 filed Oct. 29, 2018. The subject matter of this earlier-filed application is hereby incorporated by reference in its entirety.

STATEMENT OF FEDERAL RIGHTS

The United States government has rights in this invention pursuant to Contract No. 89233218CNA000001 between the United States Department of Energy and Triad National Security, LLC for the operation of Los Alamos National Laboratory.

FIELD

The present invention generally relates to electromechanical x-rays (MEXRAY), and specifically, to a UV LED driven photocathode for direct current electron guns and sources, for example on a Van De Graaff accelerator.

BACKGROUND

Since Einstein's discovery of the photoelectric effect, the emission of electrons off of solid surfaces in response to light has been common. Normally, such an emission is called a "photocathode".

Historically, photocathodes have been created by shining intense lasers onto metals, such as copper or magnesium, or with visible light onto salts (CsI). Recently, exotic photocathode materials have been under study due to the need for low emittance, pulsed electron guns. One niche market that has not been explored is the use of ordinary photocathode materials combined with UV LEDs for use with DC electron guns. One reason for this lagging study is the lack of very high voltage (~1 MV) direct current (DC) electron sources.

Accordingly, an improved photocathode using deep UV LEDs and/or MEXRAY high voltage source may be beneficial.

SUMMARY

Certain embodiments of the present invention may provide solutions to the problems and needs in the art that have not yet been fully identified, appreciated, or solved by conventional x-ray technology. For example, some embodiments of the present invention pertain to an improved photocathode used in combination with deep UV LEDs and MEXRAY high voltage source.

In an embodiment, an apparatus includes a MEXRAY configured to charge capacitor plates or balls using a small, high-voltage direct current. The apparatus also includes UV LED driven photocathode device configured to control a dose rate of the MEXRAY.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments of the present invention pertain to a UV LED driven photocathode device for the MEXRAY. The MEXRAY is configured to charge parallel-capacitor plates using a small, high-voltage direct current. The UV LED driven photocathode device, which is housed within the MEXRAY, is configured to control a dose rate of the MEXRAY.

MEXRAY

Figure 1:
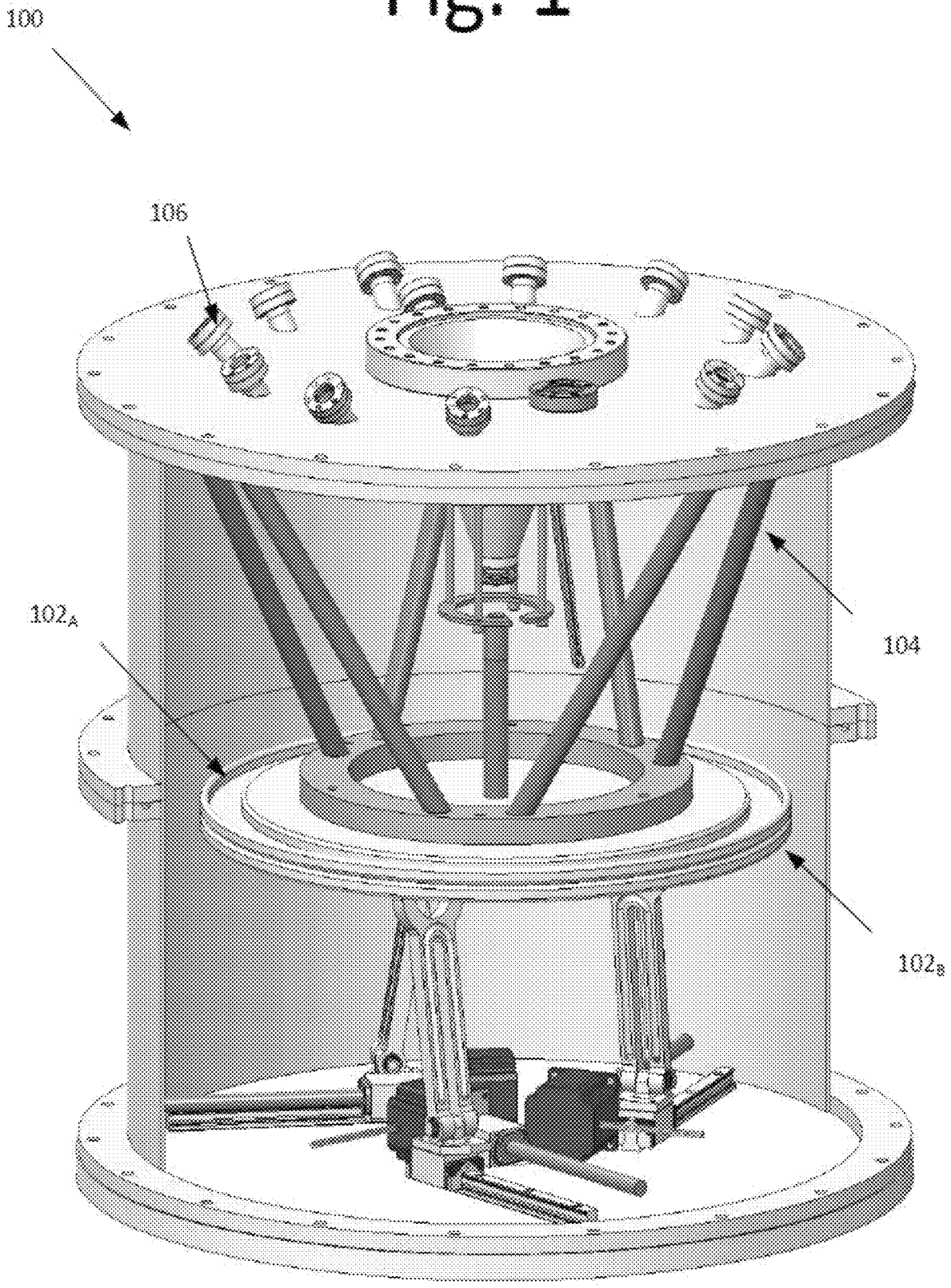
FIG. 1 is a diagram illustrating a MEXRAY, according to an embodiment of the present invention.

FIG. 1 is a diagram illustrating an electromechanical x-ray generator (or MEXRAY) 100, according to an embodiment of the present invention. In an embodiment, MEXRAY 100 may utilize a small, high-voltage, DC-to-DC converter to charge a capacitor.

In an embodiment, charged, capacitor plates $\mathbf{102}_A$, $\mathbf{102}_B$ are separated to create high voltages necessary for x-ray generation. Capacitor plates $\mathbf{102}_A$, $\mathbf{102}_B$ are charged in a large vacuum tube using a charging voltage of approximately 20 kilovolts (kV). In one embodiment, a hexapod insulator 104 is used to hold off the high voltage from ground.

During operation, mechanically separating capacitor plates $\mathbf{102}_A$, $\mathbf{102}_B$ raises the voltage of cathode plate $\mathbf{102}_A$. Electrons are liberated from the cathode onto a high-Z anode, whereupon the impact creates bremsstrahlung x-rays.

In an embodiment, MEXRAY 100 includes optical ports 106. Using optical ports 106, UV laser light, pointing at a photocathode, is introduced into MEXRAY 100. In another embodiment, MEXRAY 100 includes a ring lighter of multiple, UV LEDs configured to emit light onto the photocathode.

UV Photocathodes

In some embodiments, MEXRAY 100 uses a UV LED driven photocathode device to control and/or modulate the dose rate of MEXRAY 100. See FIG. 2, which is a diagram illustrating a UV LED driven photocathode device 200, according to an embodiment of the present invention. In this embodiment, a ring lighter 202 is composed of eight UV LEDs 204, which are individually coupled to eight diameter ball lenses 206. Ball lenses 206 may serve to efficiently concentrate the light onto the photocathode surface.

Figure 2:
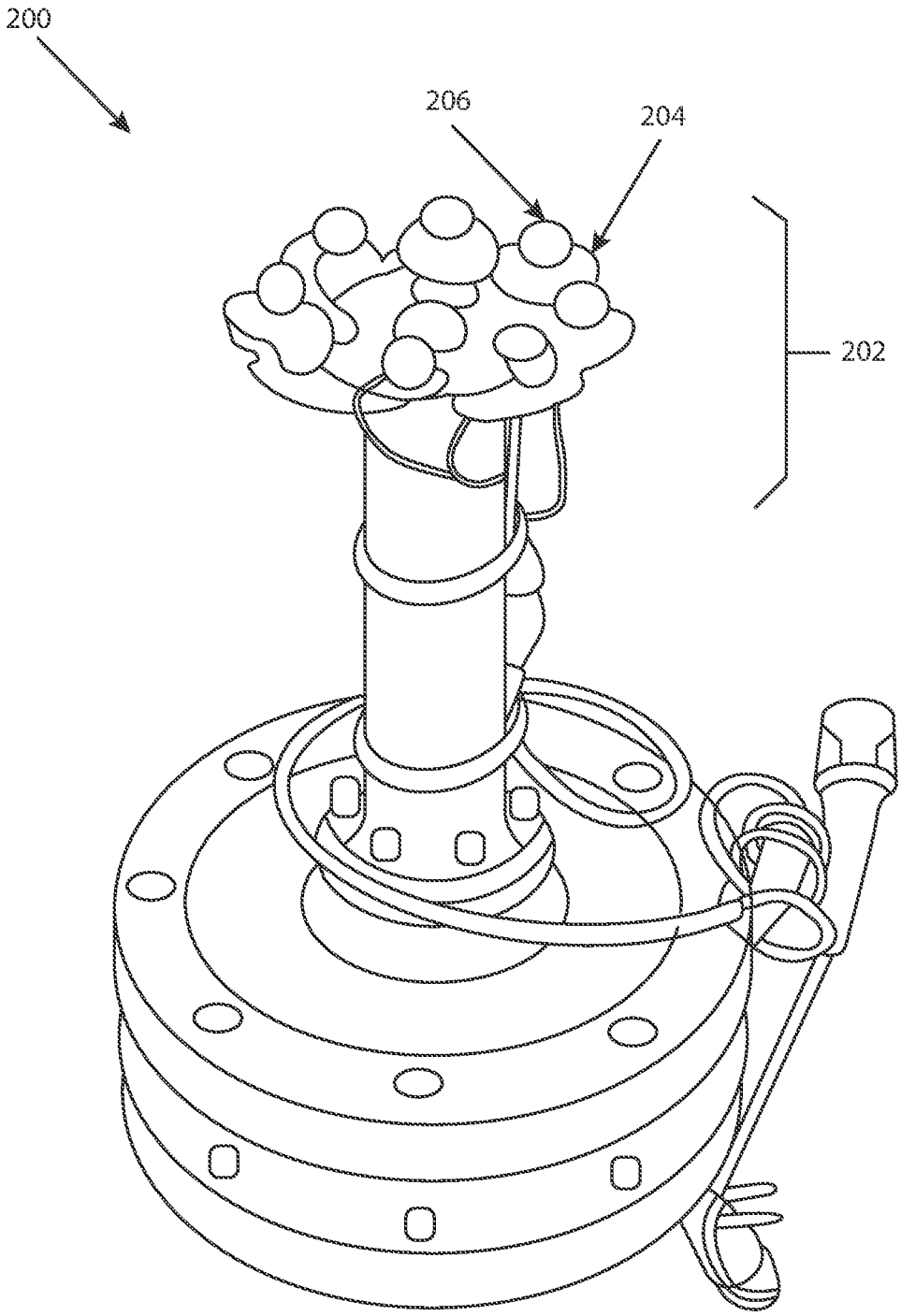
FIG. 2 is a diagram illustrating a UV photocathode device, according to an embodiment of the present invention.

Although FIG. 2 shows eight UV LEDs 204 and eight diameter ball lenses 206, the embodiments are not limited to eight. Rather, n number of UV LEDs 204 and diameter ball lenses 206 may be used depending on the specific requirements of the MEXRAY.

Figure 3:
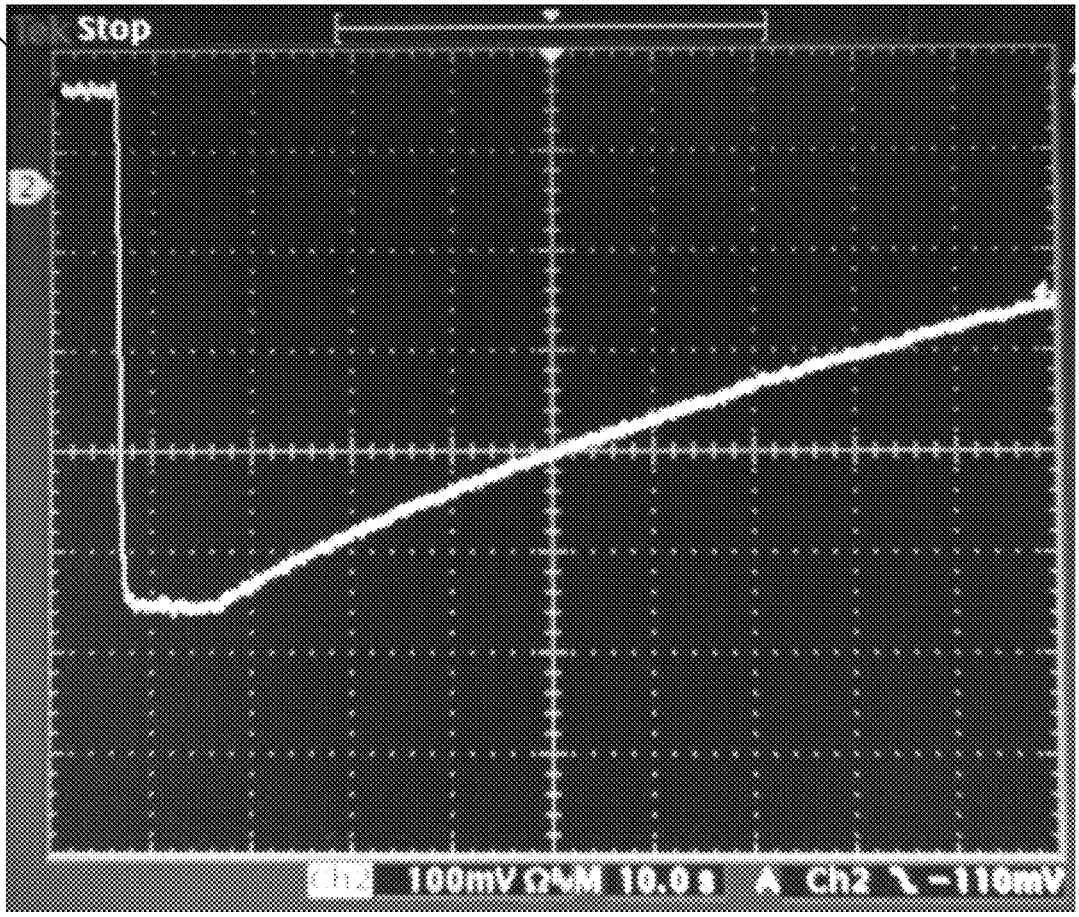
FIG. 3 is a graph illustrating AK gap voltage versus time (charging, stead-state, and photo-cathode illuminated), according to an embodiment of the present invention.

UV light is incident on a photocathode (e.g. bare magnesium) with optical power of ~30 mW. Charge liberation is over a relatively short period of time, in some embodiments. See, for example, FIG. 3, which is a graph 300 illustrating voltage versus time when the LED is turned on, according to an embodiment of the present invention. In graph 300, line 302 shows that the voltage is constant when the LED is not on. However, when the LED is turned on, the voltage is reduced, then slowly decreases, as shown in line 302, in relation to time.

Returning to FIG. 2, during operation, UV LED driven photocathode device 200 is placed inside of MEXRAY 100 of FIG. 1 and light from UV LEDs 204 is emitted towards the cathode. In another embodiment, the UV LED driven photocathode device may be housed within another vacuum, DC source such as a Van De Graaf accelerator.

With this embodiment, the UV LEDs 204 provide for an intense light source onto the cathode within MEXRAY 100 of FIG. 1. The use of MEXRAY in combination with a UV LED driven photocathode device provides for DC sources to be more effectively utilized. This combination allows the LEDs, which are low-power, and easily controlled light source, to modulate the much higher energy photo-electrons on the photocathode acting as a sort of optical amplifier.

Figure 4:
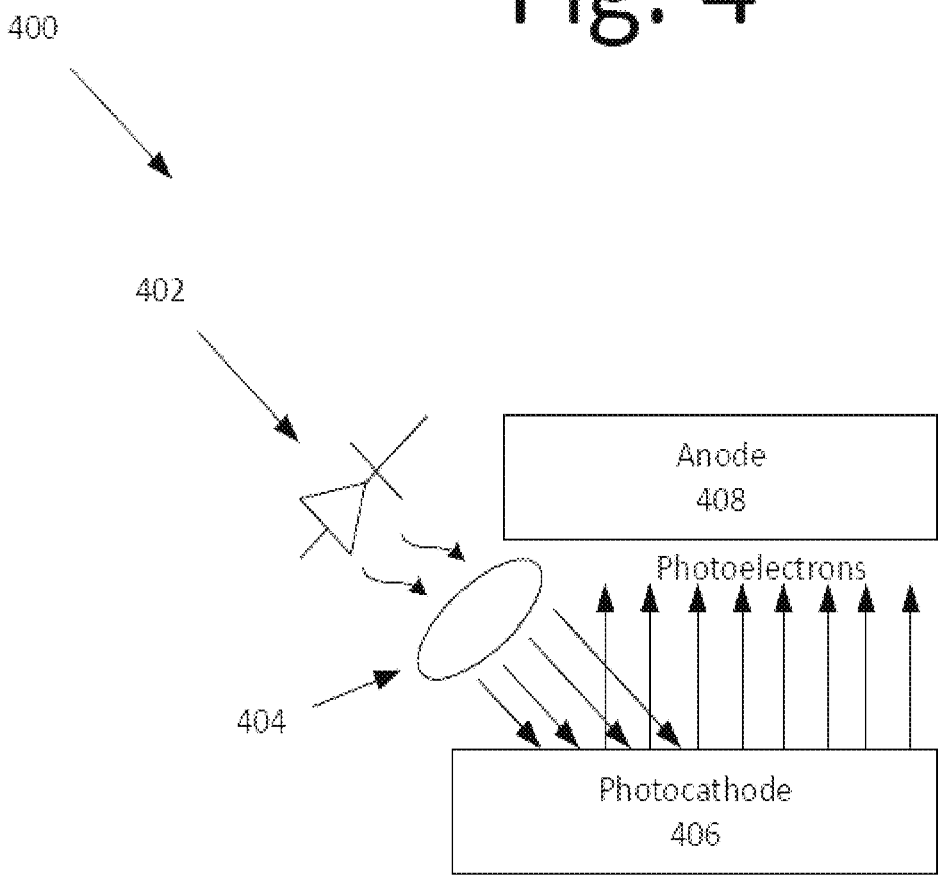

FIG. 4 is a diagram illustrating a photocathode device 400, according to an embodiment of the present invention. In an embodiment, a UV LED ring-lighter 402 is configured to emit light toward a photocathode 406 via a plurality of lenses 404. UV LED ring-lighter 402 may be composed of one or more LEDs (not shown). The emitted light is converted into photoelectrons upon impact with photocathode 406. The photoelectrons are then emitted towards an anode 408, for example.

It should be appreciated that the utilization of LEDs has become possible because of two factors. First, MEXRAY technology enables the use of a DC, high voltage diode. Secondly, the recent production of deep UV LEDs driven by commercial sterilization markets has made them cost effective at wavelengths short enough to have reasonable QE on ordinary materials (metal and amorphous diamond)

This combination can be used as a DC electron gun, a modulated electron source, and/or a modulated high-energy photon source. Because of the arbitrary temporal control unique applications like communications through highly-ionized atmospheres or shielded environments are enabled.

Normally, radio waves are modulated (either amplitude or pulse or frequency) with wavelengths of meters. In some embodiments, however, electromagnetic waves with wavelengths in the nanometer-picometer range are modulated with an LED or laser. Although numerous applications may be utilized with these embodiments, some embodiments may be used for special purpose communications (into and out of shielded containers for example), for example. At a minimum, the embodiments allow for a more exquisite and broader range of control (DC to GHz) of that type of radiation.

Some of these embodiments of the MEXRAY with photocathodes may be used with generating hard x-rays at 10^20 Hz or 100 exaHertz in a man-portable configuration. MEXRAY with photocathodes device may be use for communicating with vehicles upon atmospheric reentry (which remains an unsolved problem), for weld inspection, for hydrotesting, to name a few.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

an electromechanical x-ray generator (MEXRAY) configured to charge capacitor electrodes using a predefined-voltage direct current (DC) supply supplied by a DC source; and an ultraviolet (UV) light emitting diode (LED) driven photocathode device configured to control and modulate a dose rate of the DC electron source.

2. The apparatus of claim 1, wherein the UV LED driven photocathode device is housed within the MEXRAY or another vacuum, DC electron source.

3. The apparatus of claim 1, wherein the UV driven photocathode device comprises a light composed of a plurality of UV LEDs configured to emit light onto a photocathode within the MEXRAY or another vacuum, DC electron source.

4. The apparatus of claim 3, wherein the plurality of UV LEDs are individually coupled to a plurality of lenses.

5. The apparatus of claim 4, wherein, when the plurality of UV LEDs are turned on, the plurality of lenses are configured to concentrate light onto a surface of a photocathode.

6. The apparatus of claim 3, wherein the light emitted from a UV lighter, upon impact with a photocathode, is converted into photoelectrons which are emitted towards an anode.

7. The apparatus of claim 3, wherein, when the plurality of UV LEDs are turned on, voltage is reduced, and decreases in relation to time.

8. The apparatus of claim 3, wherein the combination of the MEXRAY and UV LED driven photocathode device allows the plurality of UV LEDs to modulate photo-electrons on a photocathode acting as an optical amplifier.

9. An apparatus, comprising:

an electromechanical x-ray generator (MEXRAY) configured to charge capacitor electrodes using a predefined-voltage direct current (DC) supplied by a DC source; and an ultraviolet (UV) light emitting diode (LED) driven photocathode device configured to control, modulate, or both, a dose rate of the DC source, wherein the UV LED driven photocathode device is housed within the MEXRAY or another vacuum, DC source to provide a light source onto a cathode within the MEXRAY or the other vacuum, DC source.

10. The apparatus of claim 9, wherein a plurality of UV LEDs are individually coupled to a plurality of lenses, allowing the light to be emitted onto the photocathode.

11. The apparatus of claim 10, wherein, when the plurality of UV LEDs are turned on, the plurality of lenses are configured to concentrate light onto a surface of a photocathode.

12. The apparatus of claim 10, wherein the light emitted from a UV lighter, upon impact with a photocathode, is converted into photoelectrons which are emitted towards an anode.

13. The apparatus of claim 10, wherein, when the plurality of UV LEDs are turned on, voltage is reduced, and decreases in relation to time.

14. The apparatus of claim 10, wherein the combination of the MEXRAY and UV LED driven photocathode device allows the plurality of UV LEDs to modulate photo-electrons on a photocathode acting as an optical amplifier.

15. An apparatus, comprising:

an electromechanical x-ray generator (MEXRAY) configured to charge capacitor electrodes using a predefined-voltage direct current (DC) supplied by a DC source; and an ultraviolet (UV) light emitting diode (LED) driven photocathode device configured to control, modulate, or both, a dose rate of the DC source, wherein the UV LED driven photocathode device comprises a light composed of a plurality of UV LEDs configured to emit light onto a photocathode within the MEXRAY or another vacuum, DC electron source.

16. The apparatus of claim 15, wherein the UV LED driven photocathode device is housed within the MEXRAY or another vacuum, DC source to provide a light source onto a cathode within the MEXRAY or the other vacuum, DC electron source.

17. The apparatus of claim 15, wherein a plurality of UV LEDs are individually coupled to a plurality of lenses, allowing the light to be emitted onto the photocathode.

18. The apparatus of claim 17, wherein, when the plurality of UV LEDs are turned on, the plurality of lenses are configured to concentrate light onto a surface of a photocathode.

19. The apparatus of claim 17, wherein the light emitted from a UV lighter, upon impact with a photocathode, is converted into photoelectrons which are emitted towards an anode.

20. The apparatus of claim 17, wherein, when the plurality of UV LEDs are turned on, voltage is reduced, and decreases in relation to time.

* * * * *